US006582570B2

(12) United States Patent
Wu

(10) Patent No.: US 6,582,570 B2
(45) Date of Patent: Jun. 24, 2003

(54) ELECTROPLATING APPARATUS FOR WHEEL DISK

(76) Inventor: Danny Wu, No. 10-8, Alley 129, Lane 223, Sec. 1, Shan Tung Rd., Chung Li City, Taoyuan Hsien (TW)

( * ) Notice: Subject to any disclaimer, the term of this patent is extended or adjusted under 35 U.S.C. 154(b) by 333 days.

(21) Appl. No.: 09/776,838

(22) Filed: Feb. 6, 2001

(65) Prior Publication Data

US 2002/0104754 A1 Aug. 8, 2002

(51) Int. Cl.[7] ..... C25D 17/06; C25D 17/10

(52) U.S. Cl. ..... 204/212; 204/199; 204/222; 204/242; 204/286.1; 204/297.01; 204/297.06; 204/297.07; 204/297.08

(58) Field of Search ..... 204/198, 199, 204/202, 212, 222, 242, 286.1, 288, 289, 297.01, 297.06, 297.07, 297.08

(56) References Cited

U.S. PATENT DOCUMENTS 3,964,987 A * 6/1976 Reppert et al. ..... 204/297.13
4,014,765 A * 3/1977 Roth et al. ..... 205/651
6,103,076 A * 8/2000 Mizuno ..... 204/288.1
6,406,542 B1 * 6/2002 Stepancik ..... 118/635

FOREIGN PATENT DOCUMENTS

JP 01147092 A * 6/1989 ..... C25D/11/04

* cited by examiner

*Primary Examiner*—Nam Nguyen
*Assistant Examiner*—Brian L. Mutschler
(74) *Attorney, Agent, or Firm*—Rosenberg, Klein & Lee

(57) ABSTRACT

An electroplating apparatus for wheel disk comprises an electrolytic cell containing electrolytic bath, a cathode plate, an auxiliary anode, at least one anode plate and a driving mechanism. Part of the auxiliary anode is provided with an insulating shielding, one end of the insulating shielding passes through the center hole of the disk wheel. Part of the auxiliary anode is exposed on both sides of the wheel disk. Therefore, the auxiliary anode forms a dual anodes scheme with the anode plate to provide complete and smooth plating. The wheel disk is rotated by the driving mechanism to prevent tip-discharging.

6 Claims, 6 Drawing Sheets

ELECTROPLATING APPARATUS FOR WHEEL DISK

FIELD OF THE INVENTION

The present invention relates to an electroplating apparatus for wheel disk, especially to an electroplating apparatus for wheel disk of various sizes and thickness, and having dual anodes.

BACKGROUND OF THE INVENTION

The electroplating is used to plate metal on surface of article to provide pleasant and radiant appearance to the article. Moreover, the electroplating can also provide anti-corrosion and high hardness.

As shown in FIGS. 1 and 2, the conventional electroplating apparatus comprises an electrolytic cell 1*a* for containing electro bath (not shown). The electrolytic cell 1*a* has a cathode plate 2*a* on topside thereof and the cathode plate 2*a* has been provided with a mounting rack 20*a* extended downward therefrom and dipped into the electro bath. The mounting rack 20*a* is used to hold the wheel disk 4*a* to be plated. The mounting rack 20*a* has different specifications to hold wheel disks 4*a* of different size, thickness and outer radius. An electrode 21*a* is arranged below the wheel disk 4*a* and in contact with the wheel disk 4*a*. The electrode 21*a* is functioned as cathode of the electrolytic cell 1*a*. Moreover, a plurality of anode plates 3*a* are provided on both sides of the wheel disk 4*a*. The cations dissolved from the anode plates 3*a* are moved toward the cathode through the electro bath and then attached on the wheel disk 4*a*. After a certain processing time, sufficient cations are attached on the wheel disk 4*a* to provide the wheel disk 4*a* with smooth and radiant appearance.

However, the wheel disks 4*a* generally have different size, thickness and outer radius, and several problems exist.

First, the wheel disks 4*a* have different size, thickness and outer radius such that different mounting rack 20*a* is required. Therefore, the mounting rack 20*a* is frequently changed to increase processing time.

Secondly, in the plating process, the electrode 21*a* continuously shocks the surface of the wheel disk 4*a*, the electrode 21*a* may be stuck on the surface of the wheel disk 4*a*. The electrode 21*a* is hard to separate from the surface of the wheel disk 4*a*, thus influencing the appearance of the wheel disk 4*a*.

Thirdly, the wheel disk 4*a* generally has complicated shape, for example, the wheel disk 4*a* may have many grooves and holes thereon. The grooves and holes may be blocked by bubble generated when the wheel disk 4*a* is dipped into the electro bath. Therefore, the locations with grooves and holes are hard to be plated.

SUMMARY OF THE INVENTION

It is the object of the present invention to provide an electroplating apparatus for wheel disk of various sizes and thickness, and having dual anodes.

In one aspect of the invention, the electroplating apparatus for wheel disk comprises an electrolytic cell containing electrolytic bath, a cathode plate, an auxiliary anode, at least one anode plate and a driving mechanism. The electroplating apparatus for wheel disk does not require the arrangement of the mounting rack and can be adapted to wheel disk of various size and thickness. The wheel disk is rotated by the driving mechanism to prevent tip-discharging. The bubble in the grooves and holes of the wheel disk floats to surface of the bath, the wheel disk can be thoroughly plated.

In one aspect of the invention, the electroplating apparatus for wheel disk comprises dual anodes. The anode plate is used to plate most area of the wheel disk and the auxiliary anode is used to plate the grooves and holes of the wheel disk, the wheel disk can be thoroughly plated.

The various objects and advantages of the present invention will be more readily understood from the following detailed description when read in conjunction with the appended drawing, in which:

DETAILED DESCRIPTION OF THE INVENTION

Figure 1:
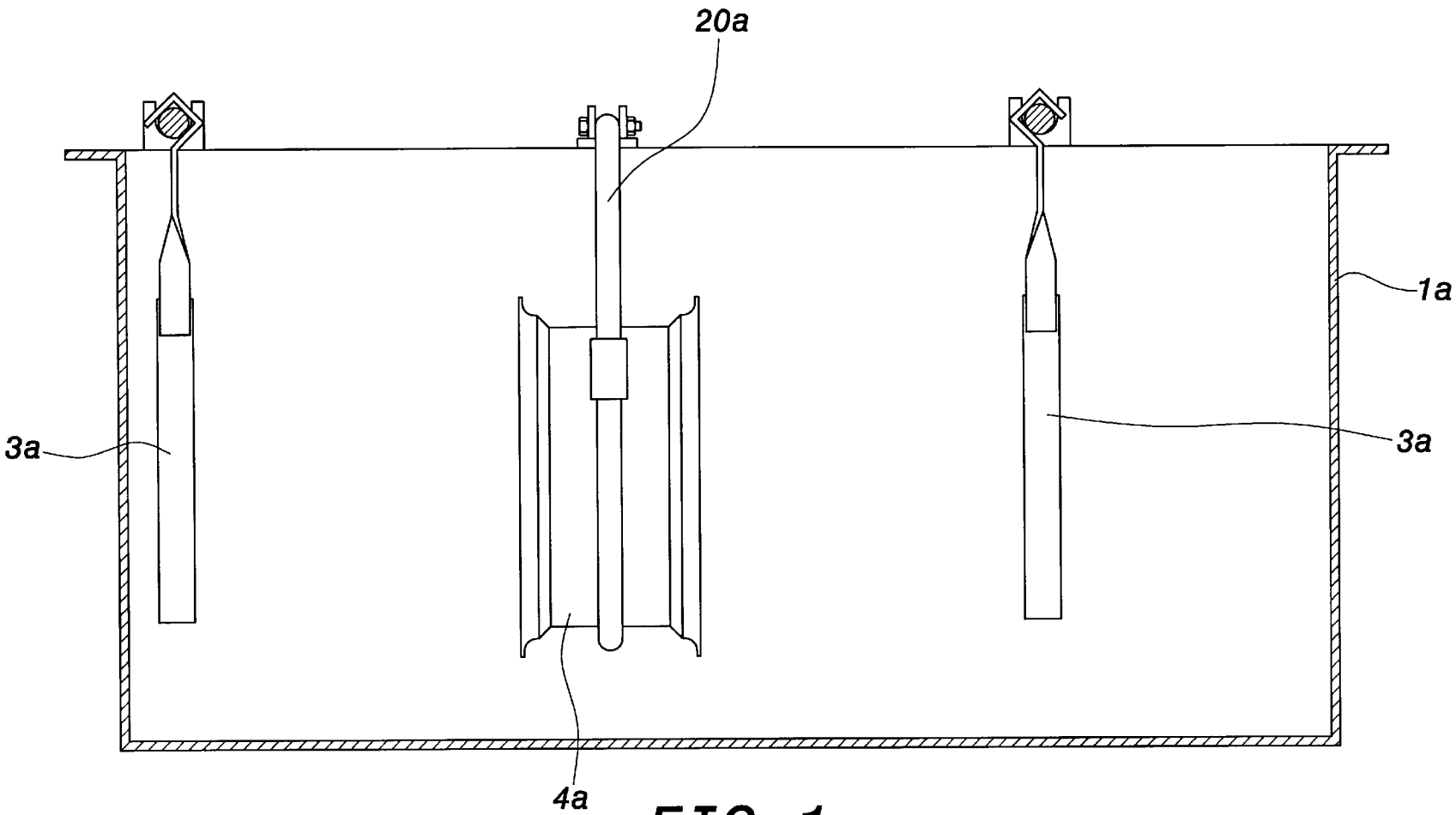
FIG. 1 PRIOR ART
FIG. 1 shows the front view of the prior art electroplating apparatus.
Figure 2:
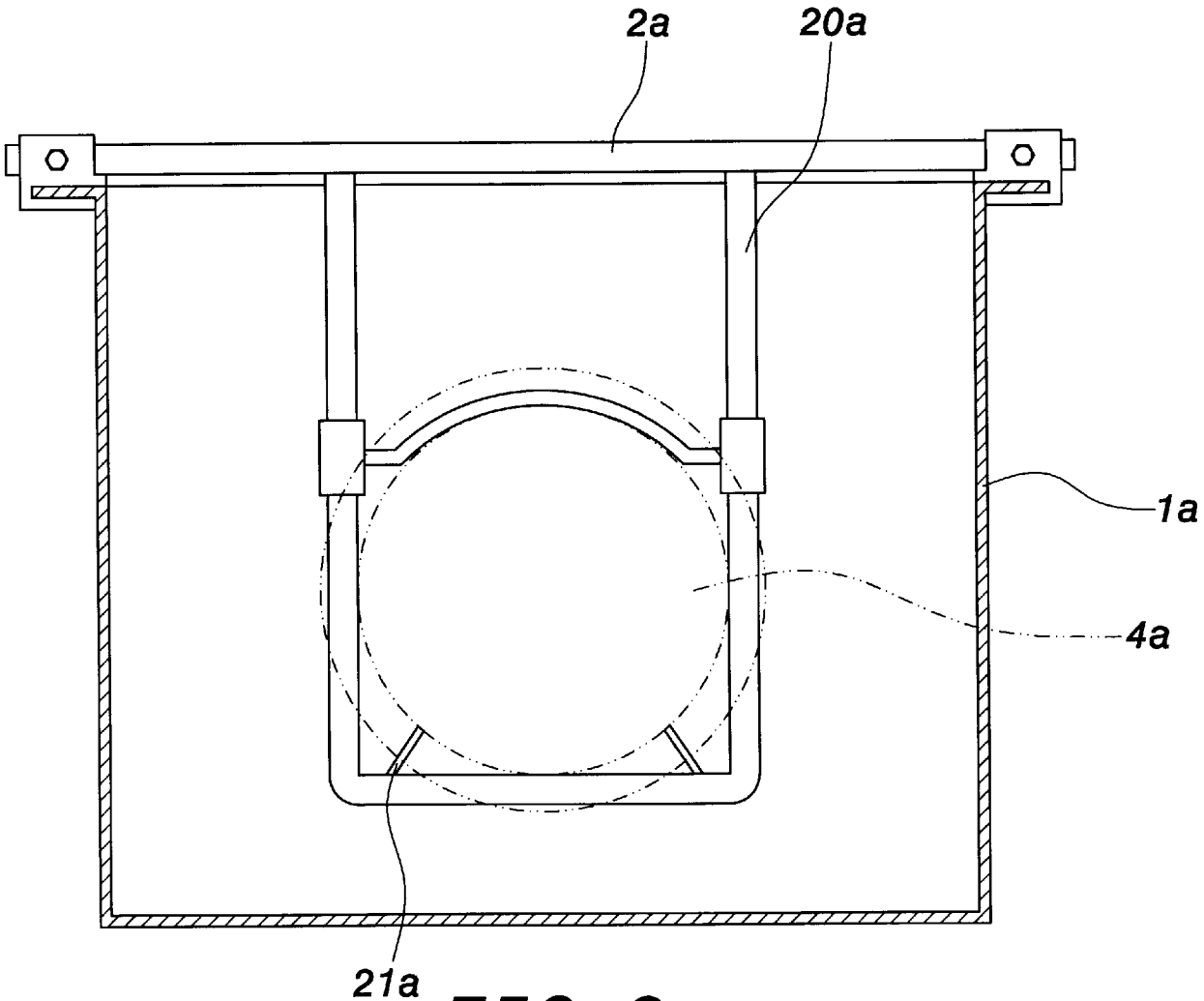
FIG. 2 PRIOR ART
FIG. 2 shows the sectional view of the prior art electroplating apparatus.
Figure 3:
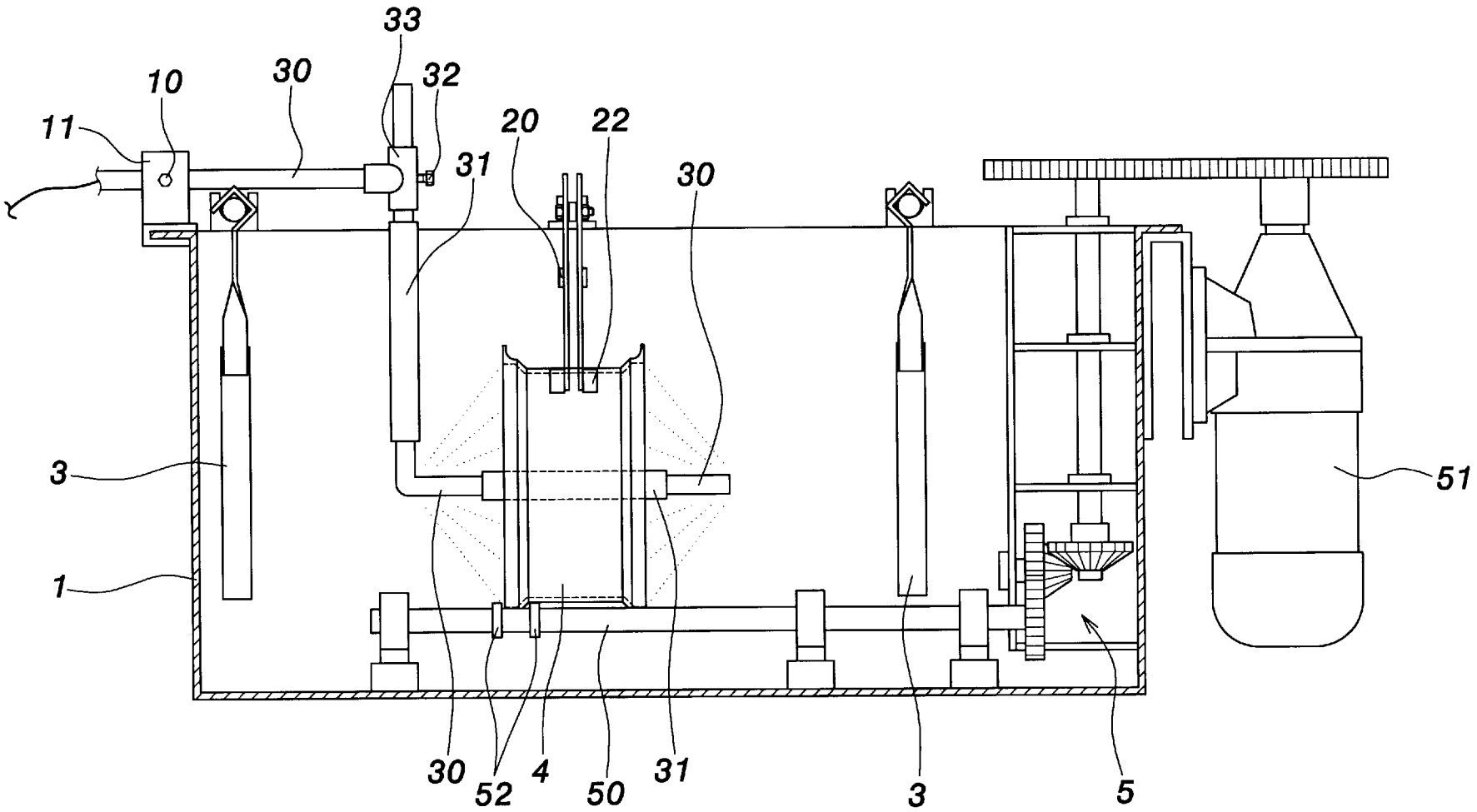
FIG. 3 shows the front view of the electroplating apparatus of the present invention.
Figure 4:
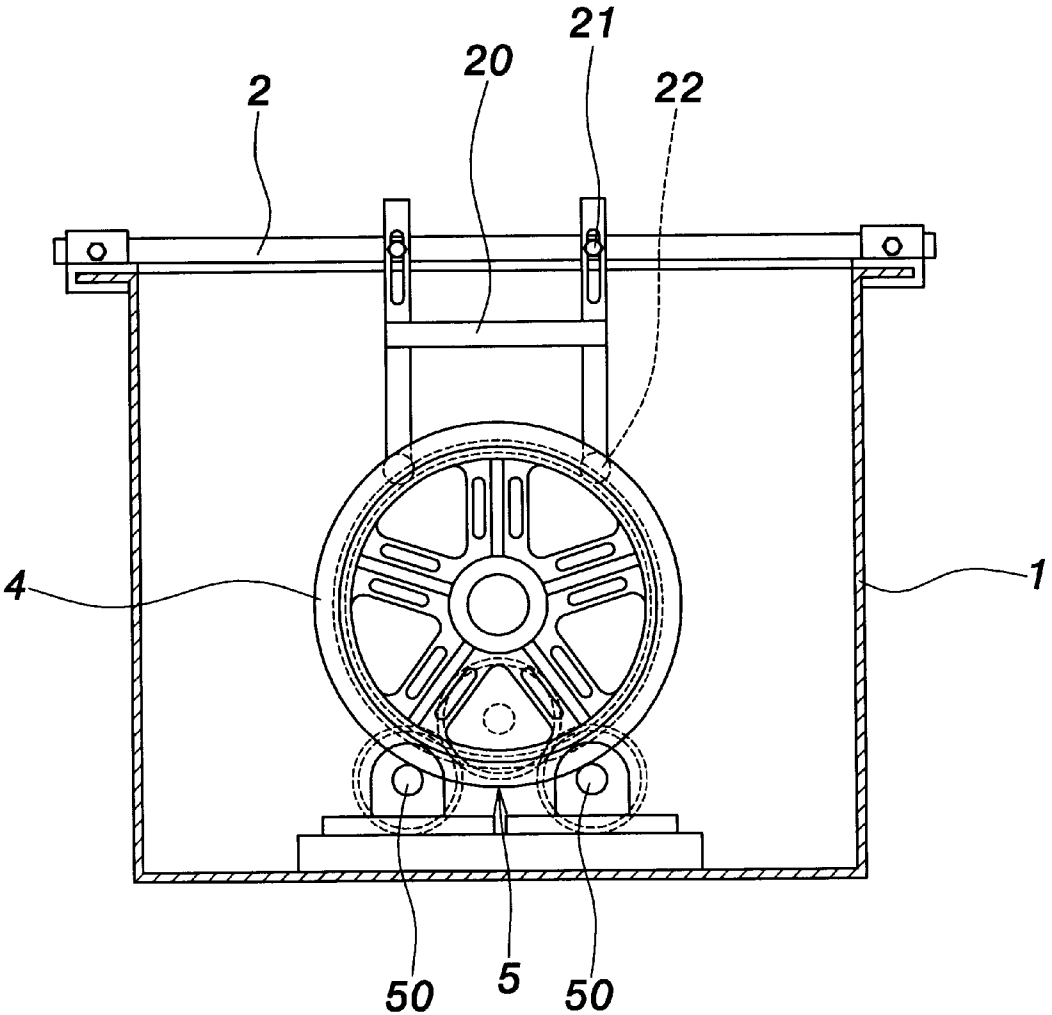
FIG. 4 shows the sectional view of the electroplating apparatus of the present invention.
Figure 5:
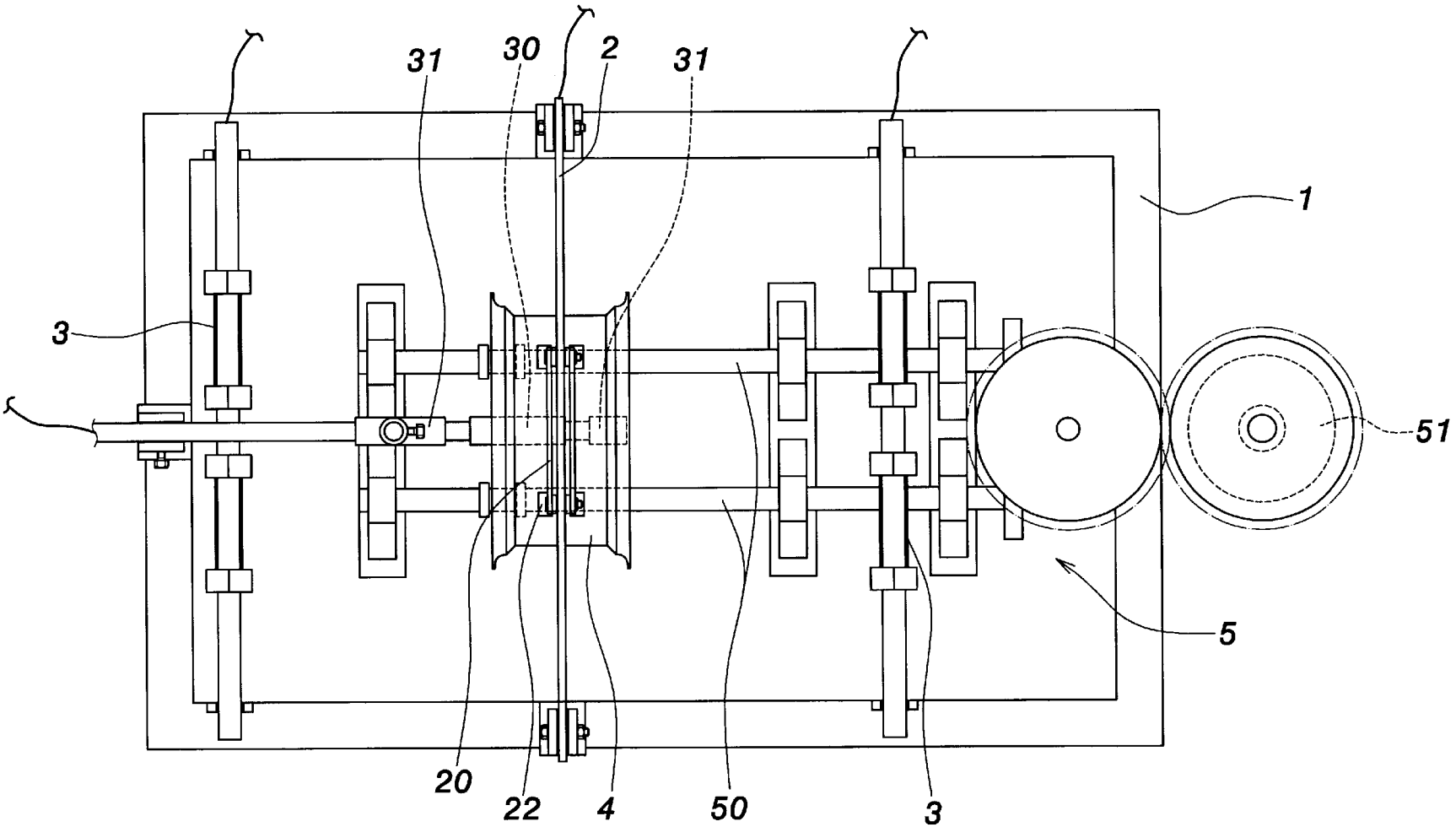
FIG. 5 shows the top view of the electroplating apparatus of the present invention.
Figure 6:
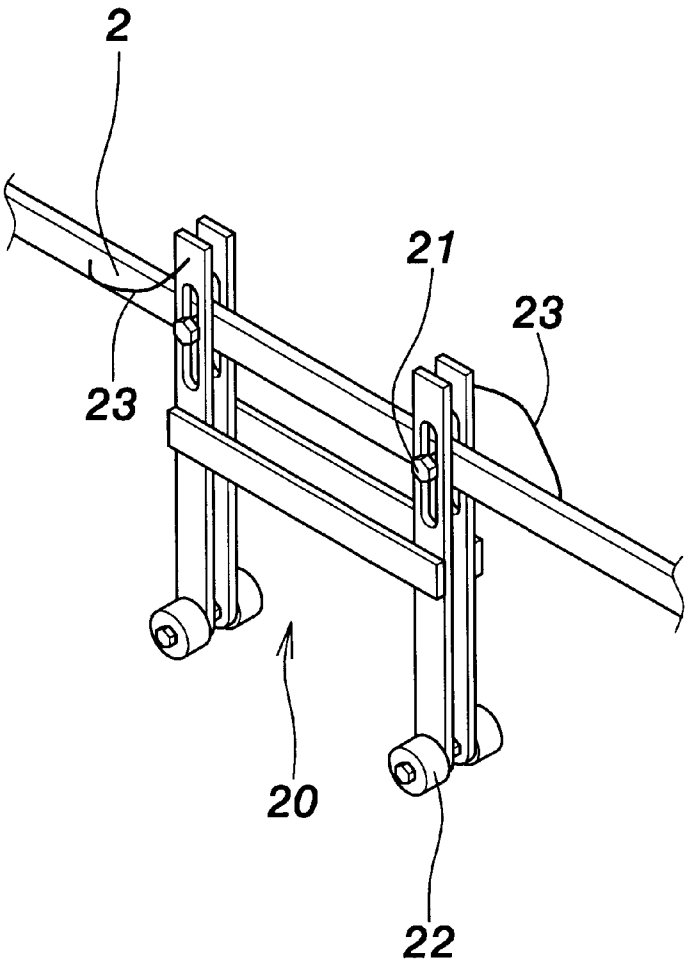
FIG. 6 shows the perspective view of the adjusting arm of the present inventions.

FIGS. 3, 4 and 5 show the front view, the sectional view and top view of the present invention, respectively. The present invention provides an electroplating apparatus for wheel disk. The electroplating apparatus comprises an electrolytic cell 1 for containing electro bath (not shown), a cathode plate 2, at least one anode plate 3, an auxiliary anode 30 and a driving mechanism 5. The cathode plate 2 is placed on topside of the electrolytic cell 1 and an adjusting arm 20 is provided below the cathode plate 2 as shown in FIG. 6. The adjusting arm 20 is connected to the cathode plate 2 by a conductive wire 23 such that the current can also flow from the cathode plate 2 to the adjusting arm 20. The adjusting arm 20 has conductive wheel 22 on bottom thereof and the adjusting arm 20 is screwed on the cathode plate 2 by adjusting screw 21 such that the adjusting arm 20 can be moved upward and downward on the cathode plate 2.

The anode plate 3 is functioned as anode of the electrolytic cell 1 and has a specific separation with the wheel disk 4 to plate most surface for the wheel disk 4.

The auxiliary anode 30 is functioned as another anode, one end thereof is screwed to a locking part 11 of the electrolytic cell 1 by a screw 10 such that the auxiliary anode 30 can be adjusted in horizontal direction. The middle part of the auxiliary anode 30 is locked to another locking part 33 by a screw 32 such that the auxiliary anode 30 can be adjusted in vertical direction. Part of the auxiliary anode 30 is covered by an insulating shielding 31 such that one end of the insulating shielding 31 passes through the center of the wheel disk 4 and the auxiliary anode 30 has portions exposed on both sides of the wheel disk 4. The exposed portions of the auxiliary anode 30 on both sides of the wheel disk 4 are functioned to plate the grooves and holes of the wheel disk 4. The conductive wheel 22 of the adjusting arm 20 is in contact with the wheel disk 4 to conduct current from the cathode to the wheel disk 4.

The driving mechanism 5 is driven by a motor 51 for driving two rollers 50 in same direction. The two rollers 50 then drive the wheel disk 4 to rotate. The roll 50 has clamping ring 52 on near outer wall of the wheel disk 4 to prevent the shift of the wheel disk 4 during rotation.

As shown in FIG. 3, a DC bias is applied between the anode and the cathode and the driving mechanism 5 drives the wheel disk 4 to rotate. At this time, the cathode plate 2 conducts current to the conductive wheel 22 in contact with the wheel disk 4 such that the wheel disk 4 is also functioned as cathode. The wheel disk 4 is continuously rotated such that the continuously rolls on the wheel disk 4 and the problem of tip-discharge is prevented. Moreover, the conductive wheel 22 will not be stuck on the wheel disk 4 after plating. Because the wheel disk 4 is continuously rotated, the bubble in the grooves and holes of the wheel disk 4 floats to surface of the bath, the wheel disk 4 can be thoroughly plated. The auxiliary anode 30 provides alternative anode for the electrolytic cell 1 and can be used to adjust the current flowing through the anode plate 3. The auxiliary anode 30 can be used to plate the grooves and holes of the wheel disk 4 such that the wheel disk 4 has complete and smooth plating layer.

Moreover, the wheel disk 4 is arranged on one end of the insulating shielding 31 of the auxiliary anode 30. By adjusting the screw 32 on the locking part 33 of the auxiliary anode 30 and the screw 21 on the adjusting arm 20, wheel disk 4 of various sizes can be easily mounted. Moreover, the electrolytic cell 1 is also provided with a locking part 11 with a screw 10, wheel disk 4 of various thicknesses also can be easily mounted.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. An electroplating apparatus for a wheel disk, comprising an electrolytic cell containing an electrolytic bath;

a cathode plate arranged on topside of the electrolytic cell and having an adjusting arm; the adjusting arm having a pivotally arranged conductive wheel;

an auxiliary anode; one end thereof locked on the electrolytic cell; part of the auxiliary anode being provided with insulating shielding, one end of the insulating shielding passing a center hole of the wheel disk, part of the auxiliary anode exposed on both sides of the wheel disk;

at least one anode plate arranged outside the wheel disk and having a predetermined separation with the wheel disk; and a driving mechanism driven by a motor and driving a roller to rotate the wheel disk.

2. The electroplating apparatus for a wheel disk as in claim 1, wherein the electrolytic cell has a locking part; one end of the auxiliary anode is screwed to the locking part by a screw.

3. The electroplating apparatus for a wheel disk as in claim 1, wherein the adjusting arm is screwed on the cathode plate by an adjusting screw.

4. The electroplating apparatus for a wheel disk as in claim 1, wherein the at least one anode plate comprises two anode plates; and the anode plates and the auxiliary anode function as anodes.

5. The electroplating apparatus for a wheel disk as in claim 2, wherein the middle part of the auxiliary anode is locked to another locking part by another screw.

6. The electroplating apparatus for 1 wheel disk as in claim 1, wherein the roller has a clamping ring on an outer wall of the wheel disk.

* * * * *